US008220084B2

(12) United States Patent
Chung

(10) Patent No.: US 8,220,084 B2
(45) Date of Patent: Jul. 17, 2012

(54) SHOWER HEAD SECURING DEVICE

(75) Inventor: Chin-Tang Chung, Lu Kang Chen (TW)

(73) Assignee: Shong I Copper Co., Ltd., Chang Hua Hsien (TW)

( * ) Notice: Subject to any disclaimer, the term of this patent is extended or adjusted under 35 U.S.C. 154(b) by 388 days.

(21) Appl. No.: 12/651,443

(22) Filed: Dec. 31, 2009

(65) Prior Publication Data

US 2011/0158763 A1 Jun. 30, 2011

(51) Int. Cl.
*A47K 4/00* (2006.01)

(52) U.S. Cl. ..... 4/570; 4/615; 248/75

(58) Field of Classification Search ..... 4/567–570, 4/601, 615–617, 675–678; 248/75
See application file for complete search history.

(56) References Cited

U.S. PATENT DOCUMENTS 3,884,258 A * 5/1975 Mull ..... 4/570
4,975,993 A * 12/1990 Black et al. ..... 4/601
6,361,005 B1 * 3/2002 Faisst et al. ..... 248/219.4
6,502,796 B1 * 1/2003 Wales ..... 248/316.1
6,651,939 B2 * 11/2003 Bischoff et al. ..... 248/75

* cited by examiner

*Primary Examiner* — Charles Phillips

(57) ABSTRACT

A shower head securing device has a shower head, a casing and a securing device. The securing device has a base, a ball tube, a securing screw, a shaft, the plurality of elastic pieces, the plurality of engaging pieces, a securing member and an adjusting screw.

5 Claims, 15 Drawing Sheets

SHOWER HEAD SECURING DEVICE

BACKGROUND OF THE INVENTION

1. Field of the Invention

The present invention relates to a shower head securing device, and more particularly to a shower head securing device which is easy to adjust.

2. Description of the Related Art

Currently, most prior art shower head securing devices comprise, as shown in FIGS. 12 and 13 or as shown in U.S. Pat. No. 6,651,939, a shower head 50, a casing 60 and a securing device 70. The securing device 70 comprises a base 71, a first connecting member 72, a second connecting member 73, a shaft 74, a plurality of flat washers 75, a plurality of engaging pieces 76, a pressing member 77 and a nut 78. The shower head 50 has a connecting pipe 51 at each side, and the connecting pipe 51 has two shower nozzles 52. The casing 60 has an opening 61 at each side. The base 71 has a first aperture 711 and a second aperture 712 at each side and a slot 713 on its upper surface. The slot 713 faces and is connected to the first aperture 711. The first connecting member 72 has a toothed engaging aperture 721 and a protruding end 722 perpendicular to its axial direction. The second connecting member 73 has a connecting tube 731 perpendicular to its axial direction; the second connecting member 73 is designed to match the joint 79, and water is able to pass through the connecting tube 731 and enter the connecting pipe 51 of the shower head 50. One end of the shaft 74 has a stop flange 741, a toothed portion 742, a threaded section 743 and a connecting end 744. The flat washers 75 and the pressing member 77 all have toothed apertures 751, 771 at their center positions. Each engaging piece 76 has a plurality of evenly spaced engaging protrusions 761 on its outer circumference and a third aperture 762 at its center position, and the diameter of the third aperture 762 is slightly larger than the outer diameter of the toothed portion 742 of the shaft 74. The nut 78 has a threaded aperture 781 at its center position and evenly spaced teeth 782 on its outer circumference.

For assembly, the flat washers 75 sandwich the engaging piece 76, and the shaft 74 is placed through the third aperture 762 and the toothed apertures 751, 771 of the engaging piece 76, the flat washers 75 and the pressing member 77. Therefore, the toothed apertures 751, 771 of the flat washer 75 and the pressing member 77 are engaged with the toothed portion 742 of the shaft 74, and the engaging piece 76 is able to spin around the shaft 74 with the third aperture 762. The shaft 74 is placed through the first connecting member 72 to engage with the engaging protrusions 761 of the engaging piece 76 and the engaging aperture 721, and then the nut 78 is screwed onto the thread section 743 of the shaft 74 with the threaded aperture 781. A plurality of elastic rings are placed between the nut 78 and the pressing member 77, such that the nut 78 can press the flat washers 75 through the pressing member 77 to secure the engaging piece 76 with proper tightness for any necessary adjustments. The shaft 74 brings the pressing member 77 and the nut 78 together into the first aperture 711 of the base 71 and causes the nut 78 to face the slot 713. The screw for securing the base 71 pushes against the connecting end 744 of the shaft 74, and the second connecting member 73 is pivoted to the base 71 through the second aperture 712 with the joint 79. Then, the casing 60 is placed over the base 71, and the shower head 50 is combined with the protruding end 722 and the connecting end 744 via the connecting pipes 51.

When a user applies force to the shower head 50 to adjust the horizontal height and spray angle of the shower head 50, if the shower head 50 is too tight or too loose, the user can remove the casing 60 and use a proper hand tool to rotate the teeth 782 through the slot 713, as shown in FIG. 14, to cause the nut 78 to press the plurality of elastic rings to push the pressing member 77 against the flat washers 75. Therefore, the two flat washers 75 sandwich the engaging piece 76 more tightly and increase the friction among the engaging piece 76 and the flat washers 75. In order to loosen the shower head 50, the nut 78 is rotated in the reverse direction to permit the elastic rings to rebound, such that the pressing member 77 releases the flat washer 75. However, the flat washers 75 and the engaging piece 76 are not released away from each other, and so the user needs to move the shower head 50 up and down to cause the first connecting member 72 to move the engaging piece 76 and the flat washer 75 away from each other to obtain the desired tightness.

Subsequently, the shower head 50 can be maintained at the desired angle, and the casing 60 is attached again.

However, the above-mentioned prior art device has following drawbacks: 1. The users needs to rotate the small sized teeth 782 through the narrow space of the slot 713 to rotate the nut 78, which is very inconvenient and difficult. 2. Frequent adjustments with the teeth 782 may cause damage to the teeth 782. 3. The plurality of elastic rings are disposed between the pressing member 77 and the nut 78, and even when the nut 78 is loosened the flat washers 75 and the engaging piece 76 remain compressed due to the surface friction between the two, as shown in FIG. 15. Therefore, an external force is required to shake the shower head 50 up and down several times to force the flat washers 75 and the engaging piece 76 to release from each other, which can be very inconvenient. 4. The flat washers 75 are mechanically engaged with the engaging piece 76; therefore, they increases the wear between the parts and reduce the usable device lifetime. 5 when the flat washers 75 and the engaging piece 76 are damaged, the entire safety of the shower head 50 is compromised. 6. Assembly of the prior art structure is complicated and induces high manufacturing costs.

Therefore, it is desirable to provide a shower head securing device to mitigate and/or obviate the aforementioned problems.

SUMMARY OF THE INVENTION

An objective of the present invention is to provide a shower head securing device.

A shower head securing device comprises a shower head, a casing and a securing device. The securing device comprises a base, a joint tube, a securing nut, a shaft, a plurality of elastic pieces, a plurality of engaging pieces, a securing member and an adjusting screw. The shower head has at least one shower nozzle and an extension tube. The casing has a first aperture and a corresponding cover at a side and an opening disposed at a central position on an upper surface. A chamber is disposed in an upper portion in a vertical protrusion of the base; the chamber has a water channel connected to a first water intake aperture and a second water intake aperture in the vertical protrusion and capable of connection to a universal joint or a ball joint. The base further comprises a securing column and at least one securing hole on a horizontal protrusion. One end of the joint tube is a jacket end with at least one seal ring; a third aperture is formed at a center position of the jacket end. A connecting tube is disposed at an outer side wall of the joint tube and connected to the third aperture; a sealed end of the joint tube has a protruding end, and a toothed securing end is formed at a center position of the protruding end. The securing nut has at least one thread at its outer circumference and a second aperture larger than the diameter of the shaft through its center position. The shaft has a plurality of engaging slots evenly placed along its outer circumference from one end to another end and parallel along its axial direction to form a protruding strip between each engaging slot. Each elastic piece has bevels on a front surface and a toothed aperture through a center portion; side ends on the surfaces of each engaging piece corresponds to the bevels of the elastic pieces. The outer circumference of each engaging piece has a plurality of evenly spaced engaging protrusions, and a fourth aperture with a diameter larger than an outer diameter of the shaft is disposed through a center portion of the engaging piece. The securing member has an engaging aperture corresponding to the engaging pieces, and at least an inner thread with a predetermined length at each opening of the engaging aperture. The adjusting screw has a thread around an outer circumferential edge, an adjusting aperture disposed on a side surface, a fifth aperture disposed on another side surface and the diameter of the fifth aperture being larger than the outer diameter of the shaft.

With the above-mentioned structure the following benefits can be obtained: 1. The user only needs to remove the cover and use the hand tool to rotate the adjusting screw to adjust the shower head without removing the casing, which is much easier than the prior art adjusting manner. 2. When the adjusting screw is loosened, the elastic pieces rebound back due to their elasticity and the two bevels to prevent friction between the elastic pieces and the engaging piece from causing adjustment difficulties. 3. When the shower head is secured, it is not mechanically engaged but held by the elastic pieces; therefore, there is much less mechanical wear on the various parts, and the securing device has a longer life time. 4. With the elastic pieces, the shower head can be secured for a long period of time which provides for increased safety. 5. The shower head securing device of the present invention has a simpler structure which provides for easier assembly and lower manufacturing costs.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
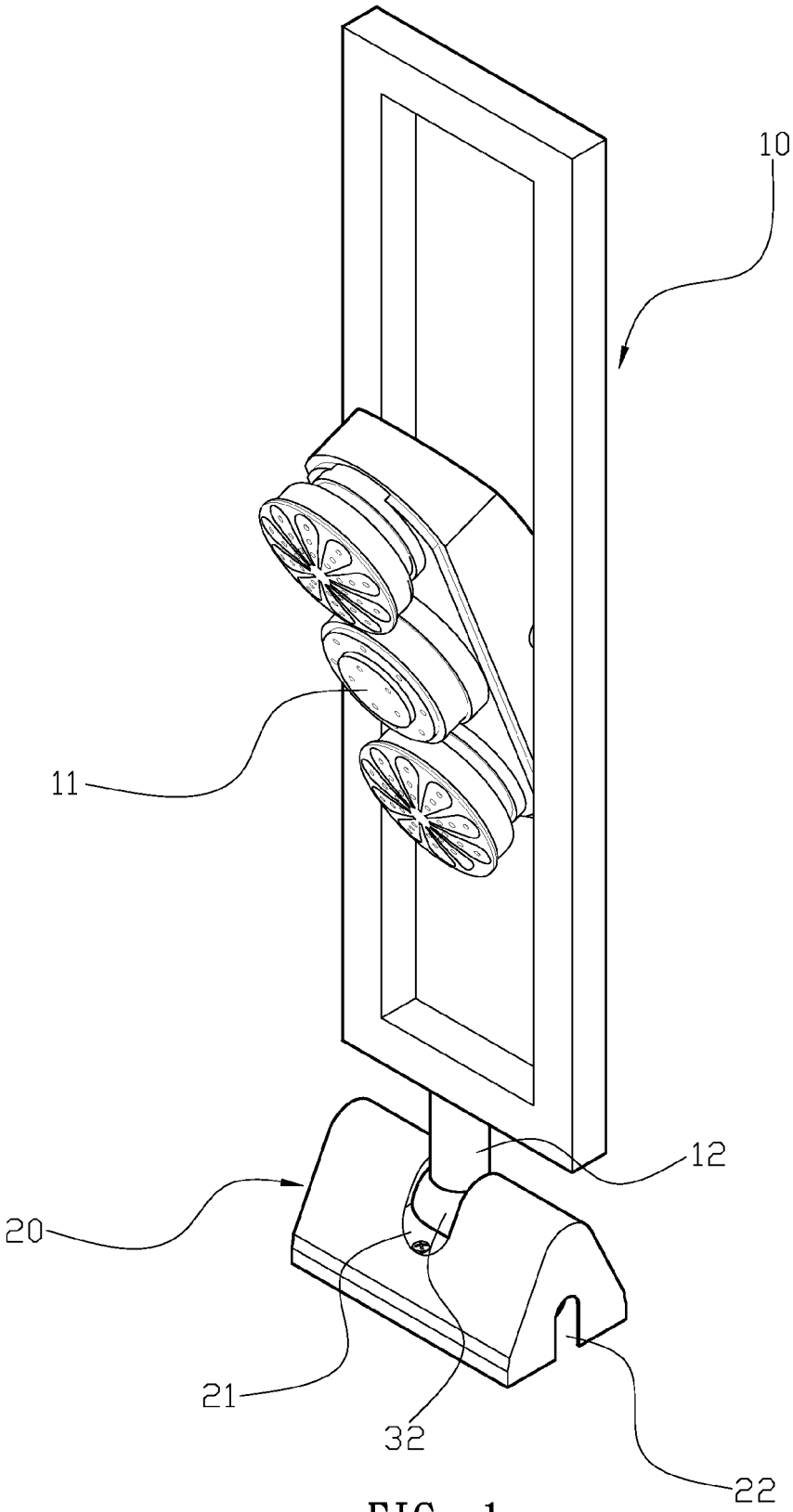
FIG. 1 is a perspective view of an embodiment of the present invention.
Figure 2:
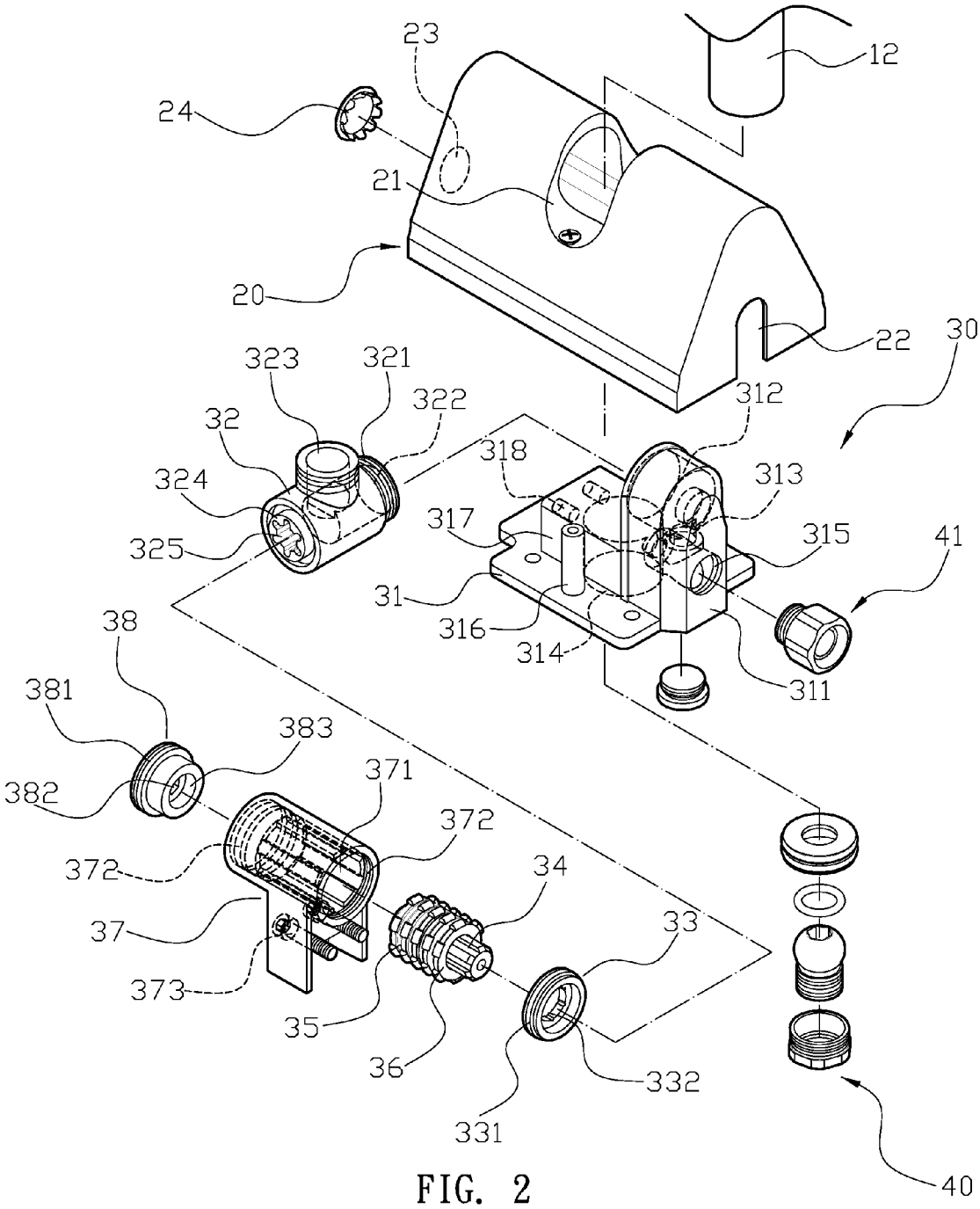
FIG. 2 is a perspective exploded view of an embodiment of the present invention.
Figure 3:
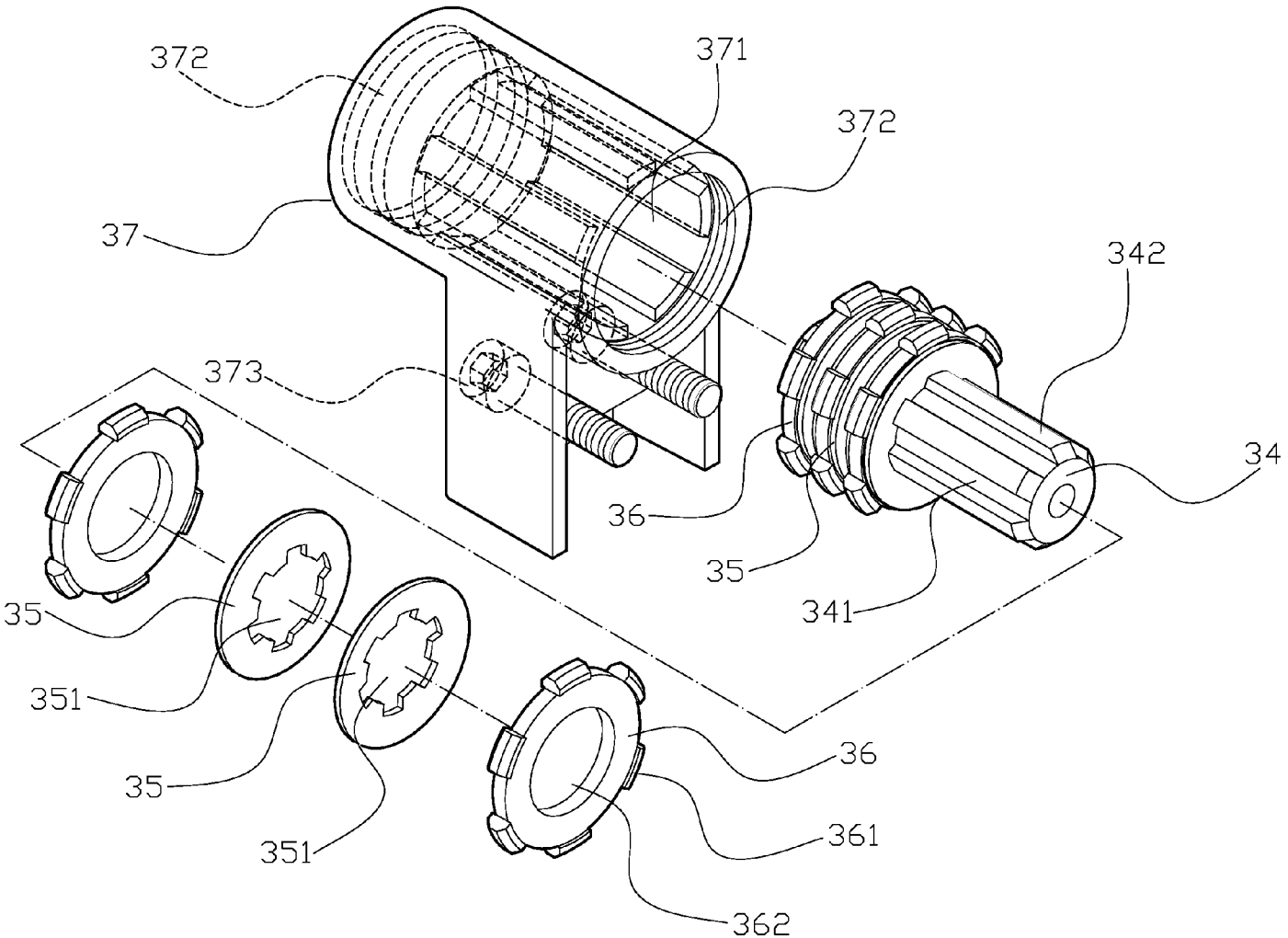
FIG. 3 is a detailed exploded perspective view of certain elements shown in FIG. 2 according to an embodiment of the present invention.
Figure 4:
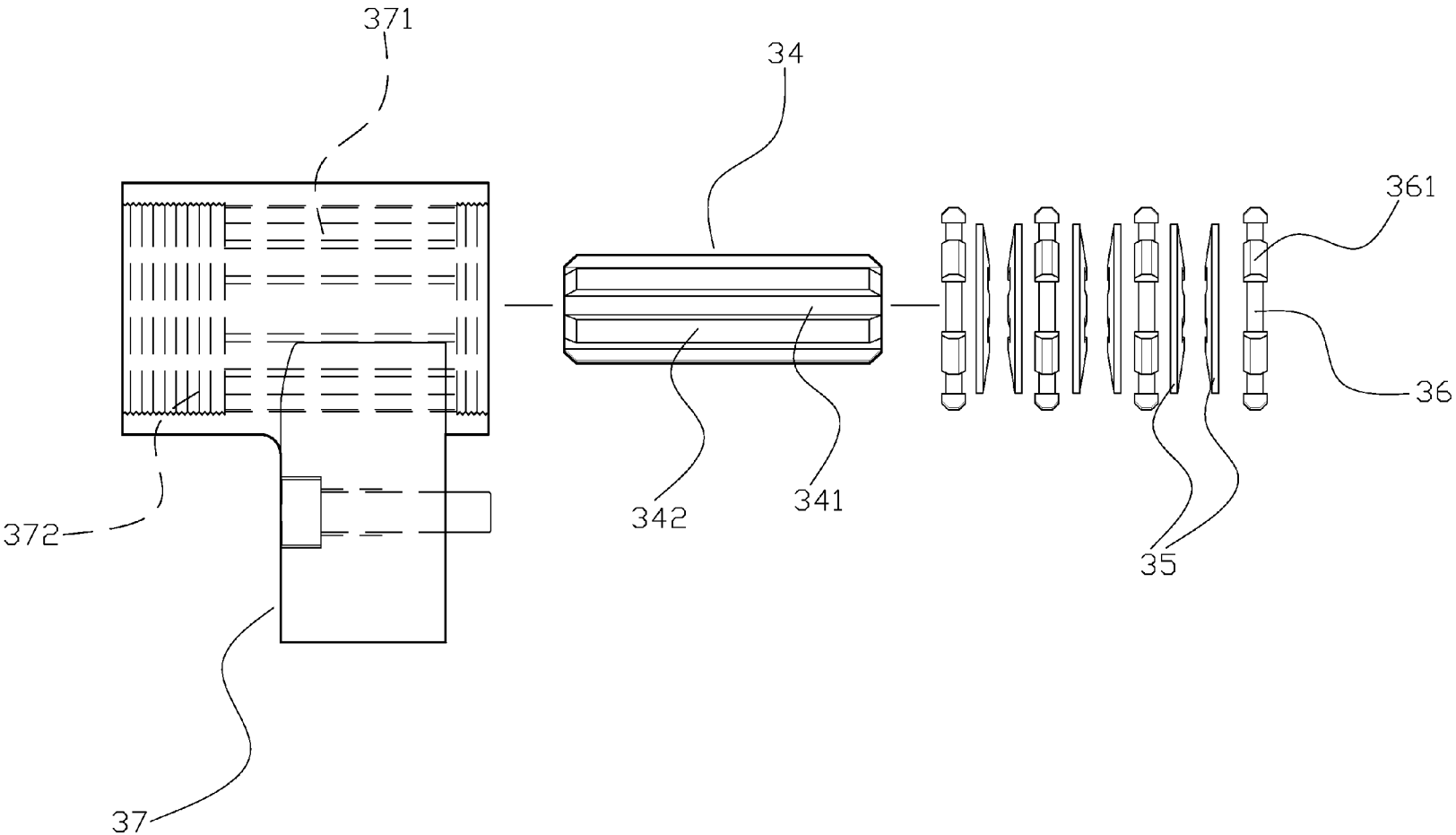
FIG. 4 is a detailed side view of certain elements shown in FIG. 2 according to an embodiment of the present invention.
Figure 5:
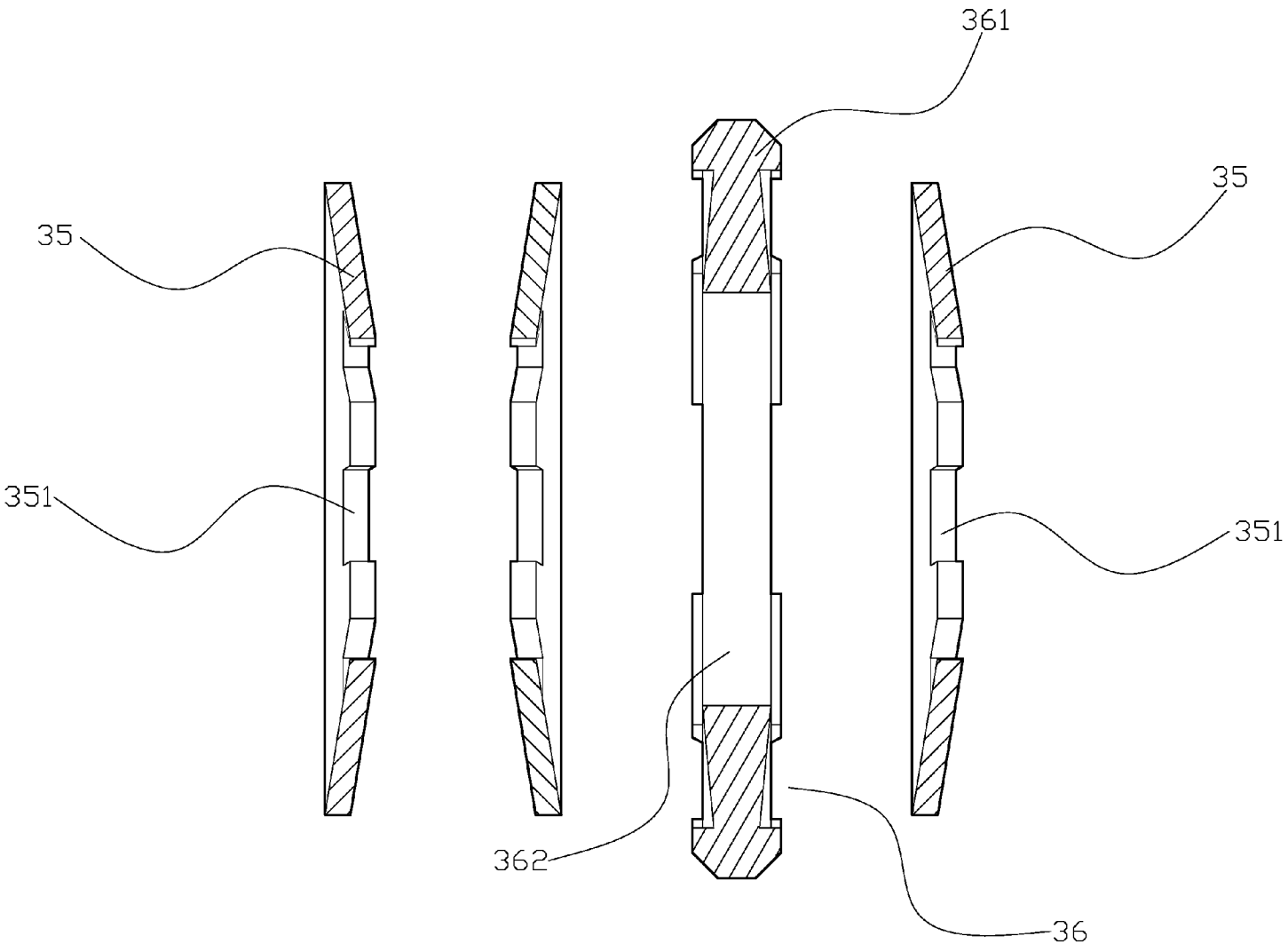
FIG. 5 is a detail cross-sectional view of elastic pieces and engaging pieces according to an embodiment of the present invention.

Please refer to FIGS. 1 to 5. A shower head securing device comprises a shower head 10, a casing 20 and a securing device 30. The securing device 30 comprises a base 31, a joint tube 32, a securing nut 33, a shaft 34, a plurality of elastic pieces 35, a plurality of engaging pieces 36, a securing member 37 and an adjusting screw 38. The shower head 10 has three shower nozzles 11 and an extension tube 12. The casing 20 has a first aperture 23 and a corresponding cover 24 on one side. A chamber 312 is disposed in an upper portion in a vertical protrusion 311 of the base 31. The chamber has a water channel 313 connected to a first water intake aperture 314 and a second water intake aperture 315 in the vertical protrusion 311 and capable of connection to a universal joint 40 or a ball joint 41. The base 31 further comprises a securing column 316 and at least one securing hole 318 on a horizontal protrusion 317. One end of the joint tube 32 is a jacket end 321 with at least one seal ring; a third aperture 322 is formed in a central portion of the jacket end 321. A connecting tube 323 is disposed on an outer side wall of the joint tube 32 and is connected to the third aperture 322. A sealed end of the joint tube has a protruding end 324, and a toothed securing end 325 is formed in a center portion of the protruding end 324. The securing nut 33 has a thread 331 on its outer circumference and a second aperture 332 that is larger than the diameter of the shaft 34 that passes through its central portion. The shaft 34 has a plurality of engaging slots 341 evenly disposed along its outer circumference from one end to another end and parallel along its axial direction to form a protruding strip 342 between each engaging slot 341. Each elastic piece 35 has two bevels on a front surface and a toothed aperture 351 through a central portion. Side ends on the surfaces of each engaging piece 36 correspond to the bevels of the elastic pieces 35; the outer circumference of each engaging piece 36 has a plurality of evenly spaced engaging protrusions 361, and a fourth aperture 362 with a diameter larger than an outer diameter of the shaft 34 that is disposed through a central portion of the engaging piece 36. The securing member 37 has an engaging aperture 371 corresponding to the engaging pieces 36, and an inner thread 372 with a predetermined length at each opening of the engaging aperture 371. The adjusting screw 38 has a thread 381 around an outer circumferential edge. An adjusting aperture 382 is disposed around a side surface, a fifth aperture 383 is disposed around another side surface, and the diameter of the fifth aperture 383 is larger than the outer diameter of the shaft 34.

Figure 6:
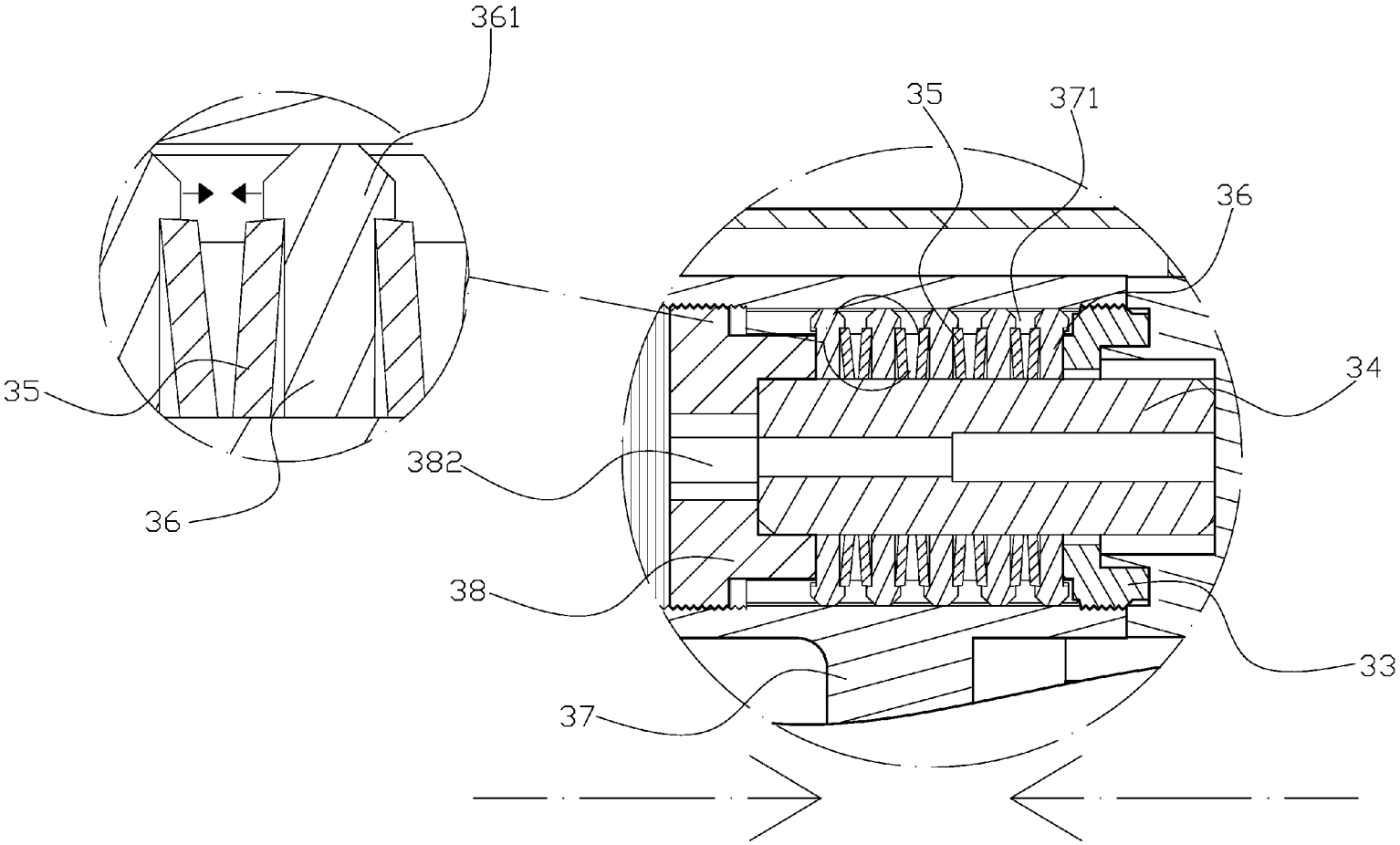
FIG. 6 is a schematic drawing of n adjusting screw being tightened according to an embodiment of the present invention.

For assembly, the engaging pieces 36 sandwich two elastic pieces 35 with both front surfaces facing each other; the shaft 34 is disposed through the fourth apertures 362 of the elastic pieces 36 and the toothed apertures 351 of the engaging pieces 35 such that the toothed apertures 351 of the elastic pieces 35 are engaged with the engaging slots 341 and the protruding strips 342 of the shaft 34. When the shaft 34 is placed into the securing member 37, the engaging protrusions 361 of the engaging pieces 36 engage with the engaging aperture 371 of the securing member 37. The securing nut 33 and the adjusting screw 38 are screwed onto the inner threads 372 disposed on the two opening edges of the engaging aperture 371 of the securing member 37, such that the adjusting screw 38 admits the shaft 34 into the fifth aperture 383 and pushes against all of the engaging pieces 36 together to deform the elastic pieces 35 to generate compression that is applied onto the shaft 34, so the shaft 34 can have a proper tightness for necessary adjustments, as shown in FIG. 6. Moreover, one end of the shaft 34 protrudes out from the second aperture 332 of the securing nut 33. The joint tube 32 is pivoted onto the base 31, and the securing member 37 is jacketed into the joint tube 32 to cause the shaft 34 to insert into the toothed securing end 325. The screw 373 is screwed into securing hole 318 to secure together the securing member 37 and the base 31. Then the casing 20 is placed on the base 31 and secured to the securing column 316 with screws, and the connecting tube 323 of the joint tube 32 is connected to the extension tube 12 of the shower head 10 in the opening 21 of the casing 20.

Figure 7:
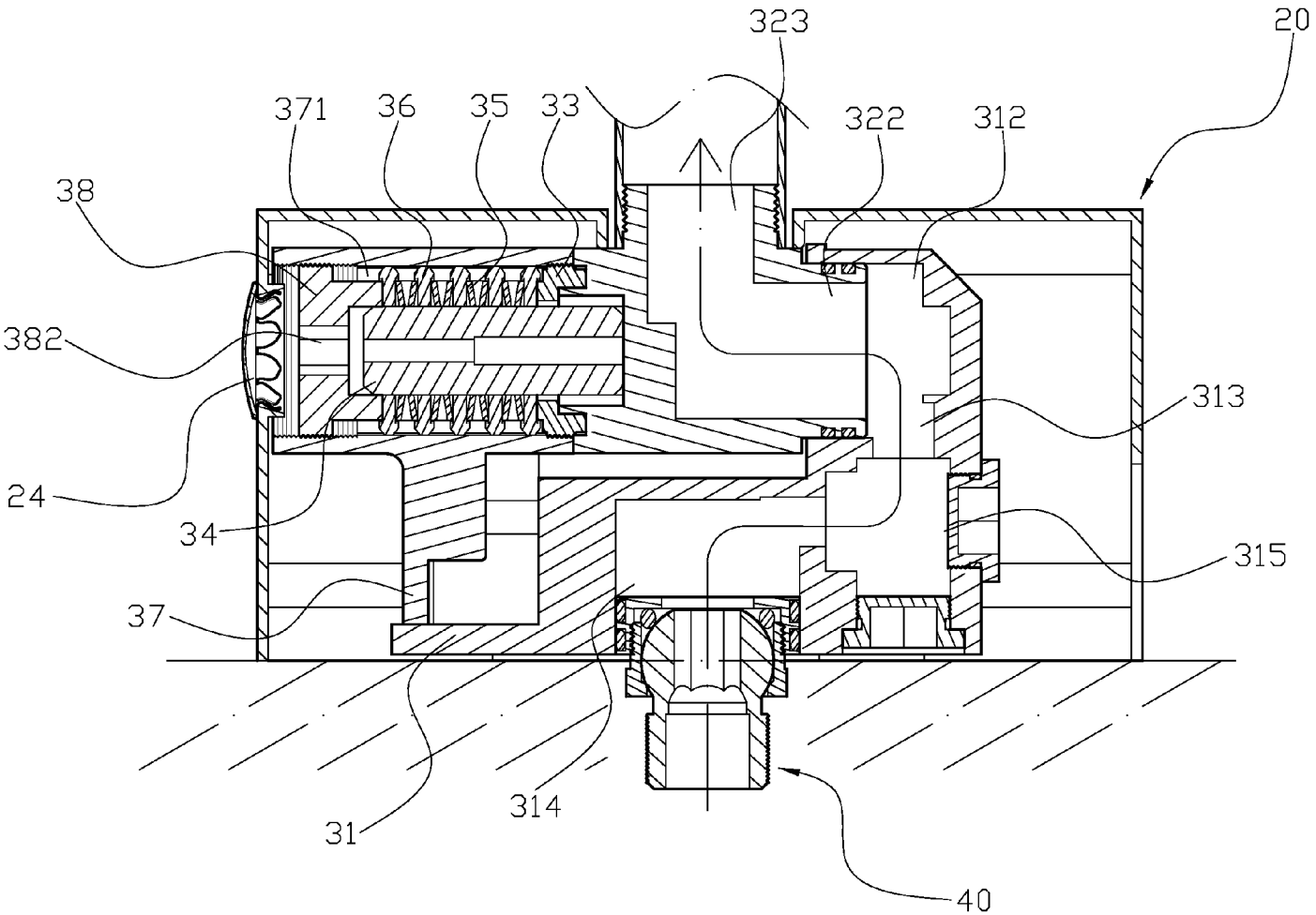
FIG. 7 is an assembly schematic drawing according to an embodiment of the present invention.
Figure 8:
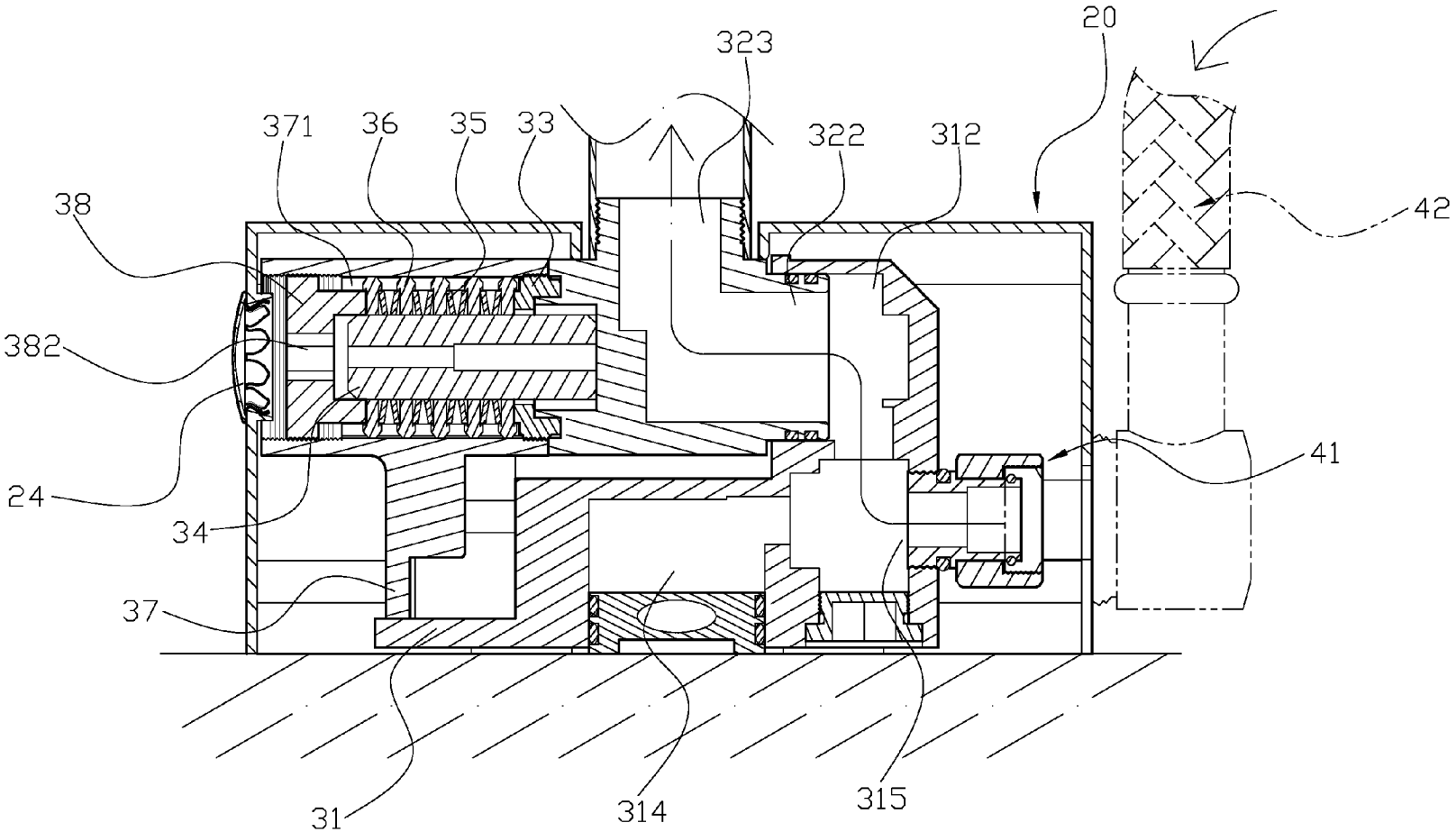
FIG. 8 is another assembly schematic drawing according to an embodiment of the present invention.

For actual usage, depending upon the pipe layout design, the first water intake hole 314 and the universal joint 40 as shown in FIG. 7 or the second water intake hole 315 and the joint 41 are connected to the flexible pipe 42. When one of the water intake holes is connected to the pipe, the other water intake hole is sealed with a plug to prevent leakage. Water enters from the water intake hole through the channel 313 into the chamber 312, and with the connection provided by the joint tube 32, through the third aperture 322, the connecting tube 323, and the extension tube 12 into the shower head 10, and is then sprayed from shower nozzle 11. While the shower head is spraying water, a user can directly push on the shower head 10 to rotate the shower head to change the angle and height of the shower head 10.

Figure 9:
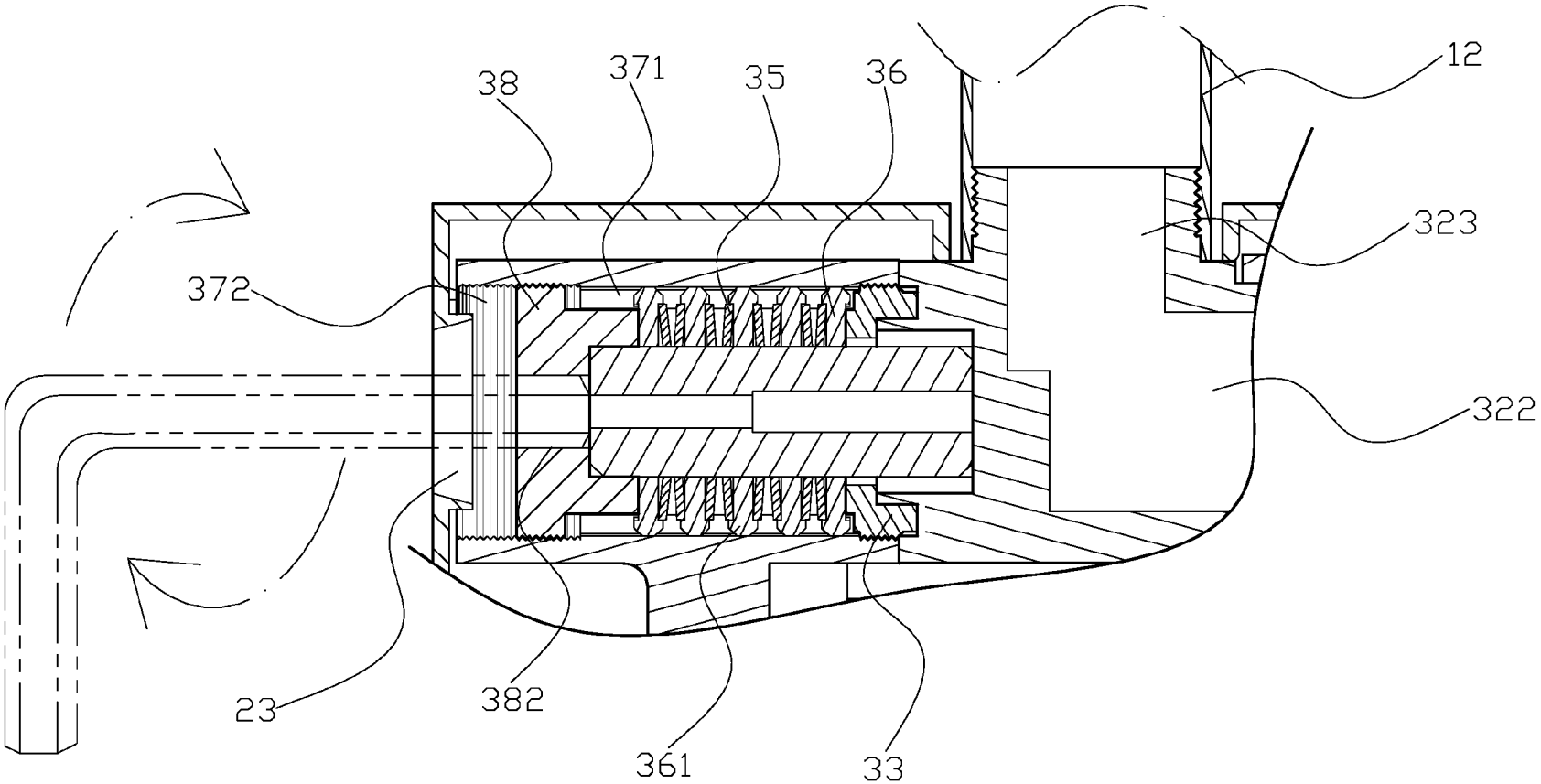
FIG. 9 is a schematic drawing of an adjusting screw being loosened according to an embodiment of the present invention.

Please refer to FIG. 9. When the user pushes the shower and feels it is too tight or too loose, in order to adjust the rotational allowance of the shower head 10, the user removes the cover 24 and use a hand tool, such as a hex key, matching the adjusting aperture 382 of the adjusting screw 38 for insertion into the first aperture 23 to rotate the adjusting screw 38.

Figure 10:
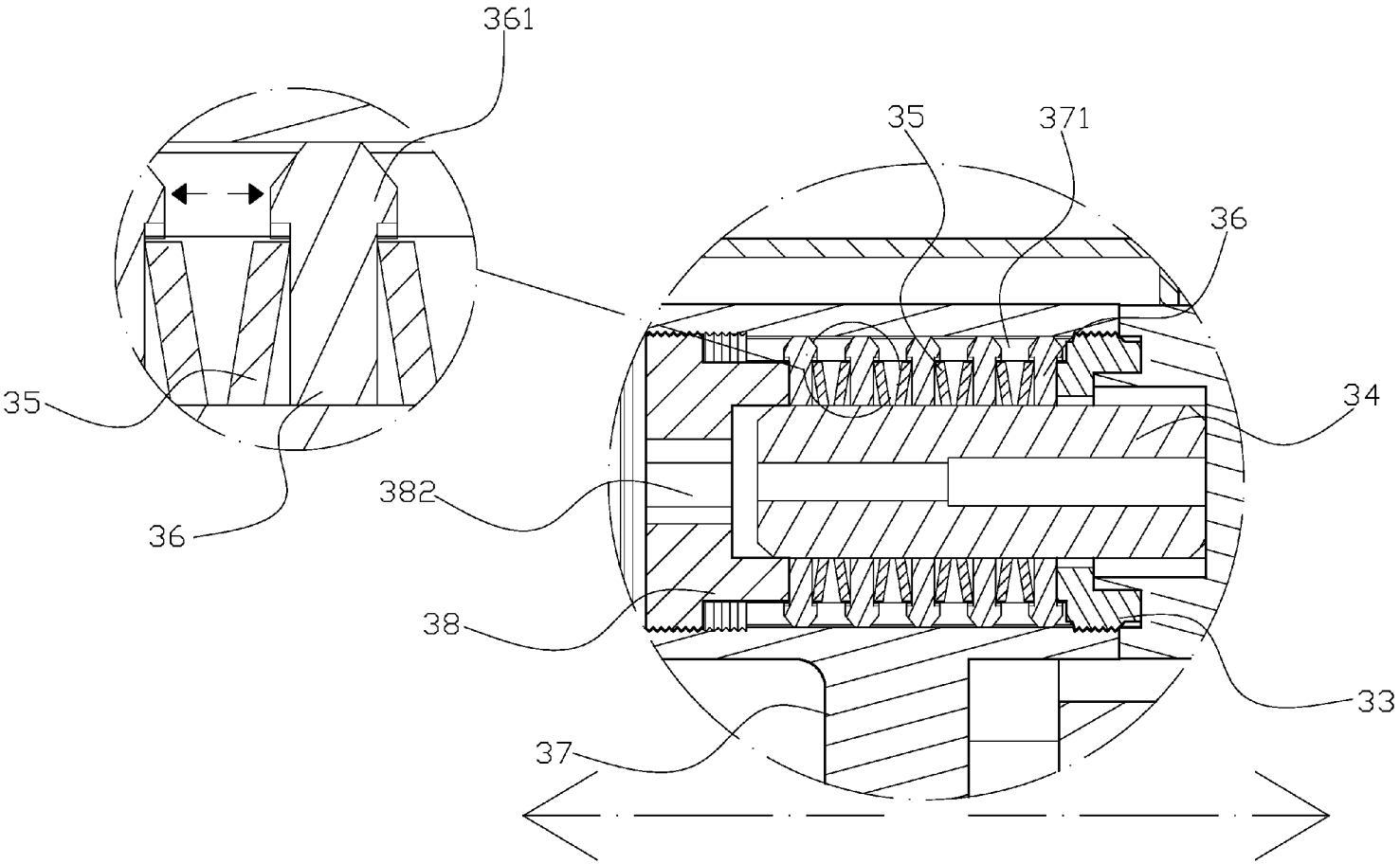
FIG. 10 is a schematic drawing of an elastic piece after the adjusting screw is loosened according to an embodiment of the present invention.
Figure 11:
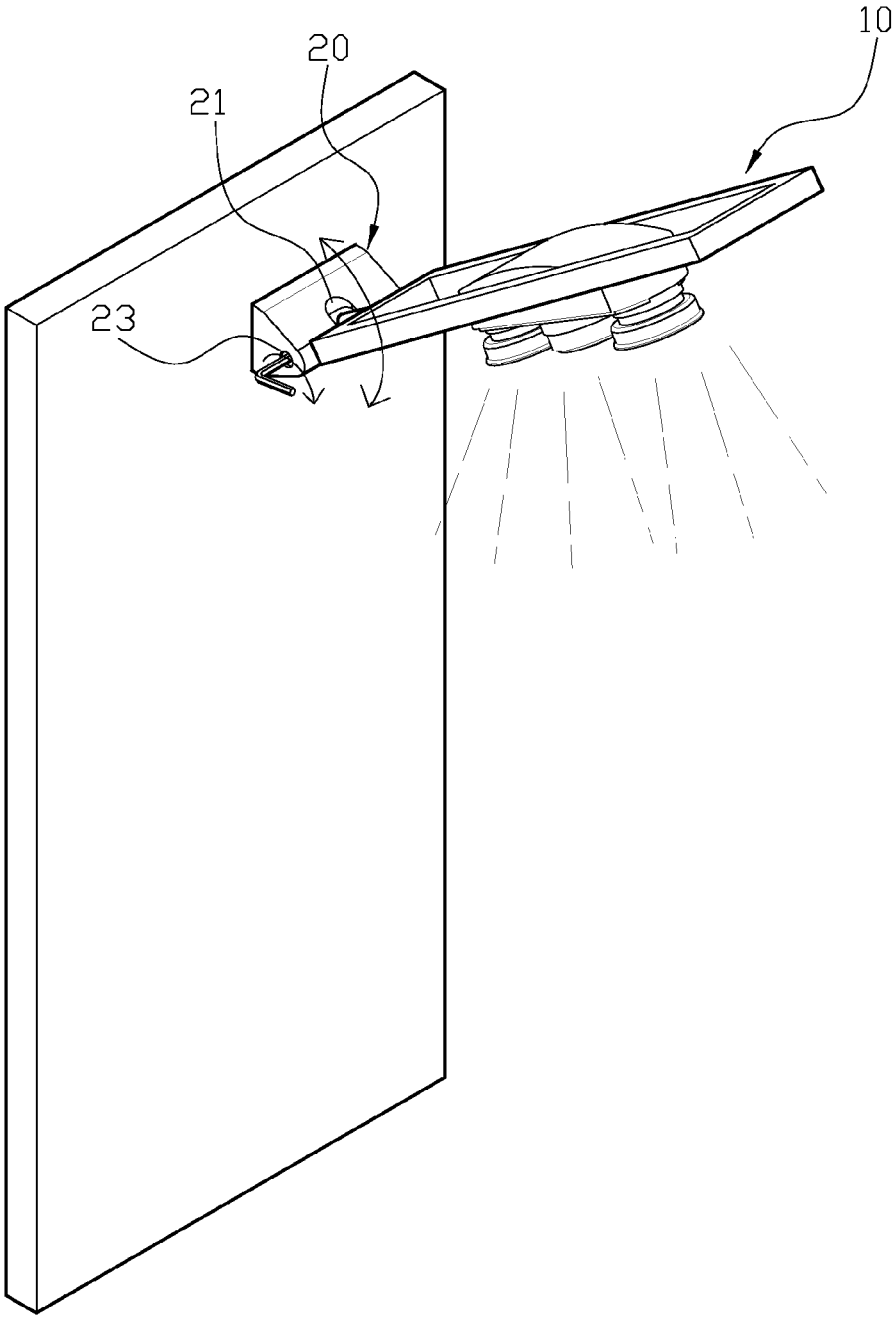
FIG. 11 illustrates adjusting a horizontal angle of a shower head according to an embodiment of the present invention.
Figure 12:
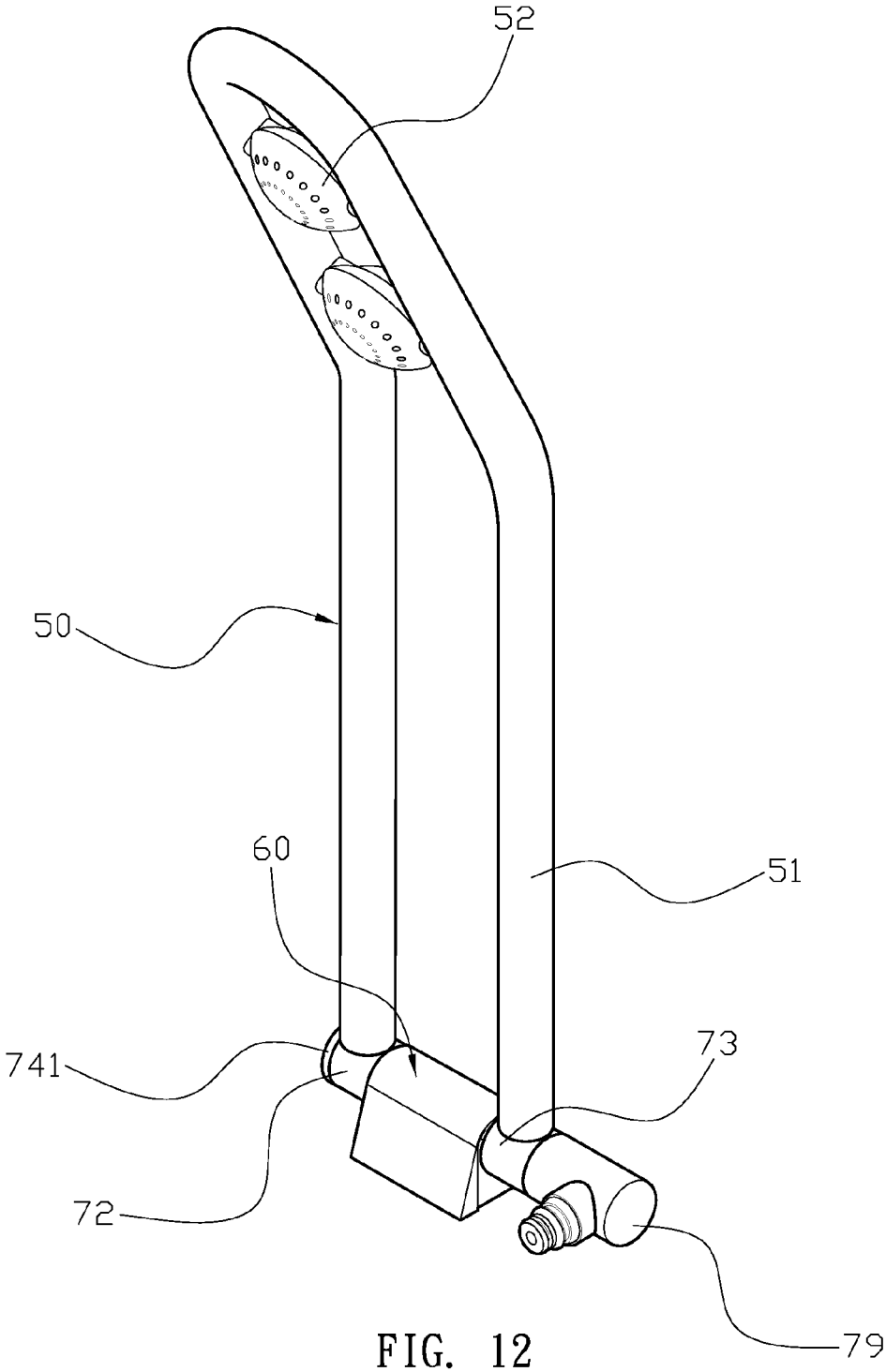
FIG. 12 PRIOR ART
FIG. 12 is a perspective view of a prior art shower head structure.
Figure 13:
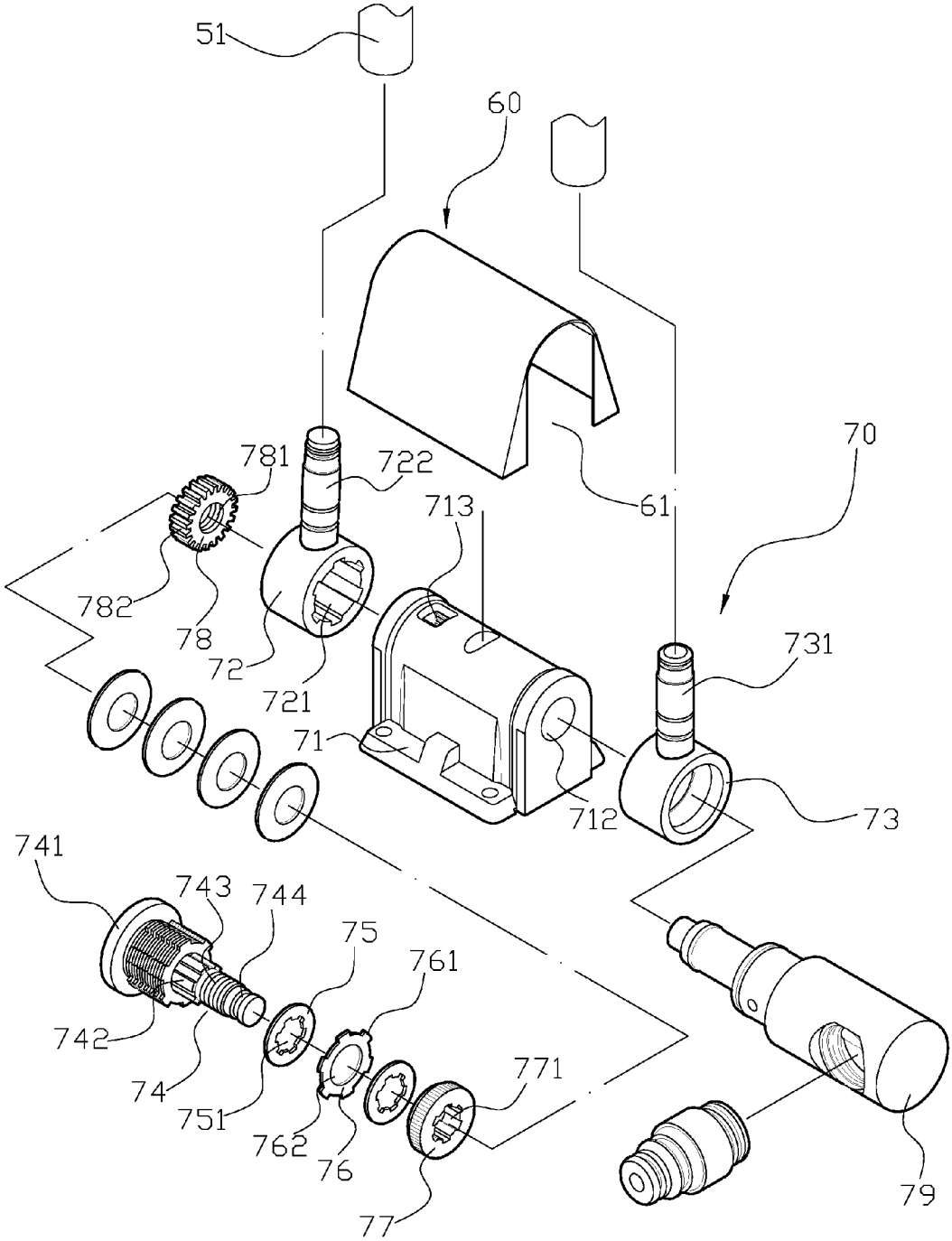
FIG. 13 PRIOR ART
FIG. 13 is a perspective exploded view of a prior art shower head structure.
Figure 14:
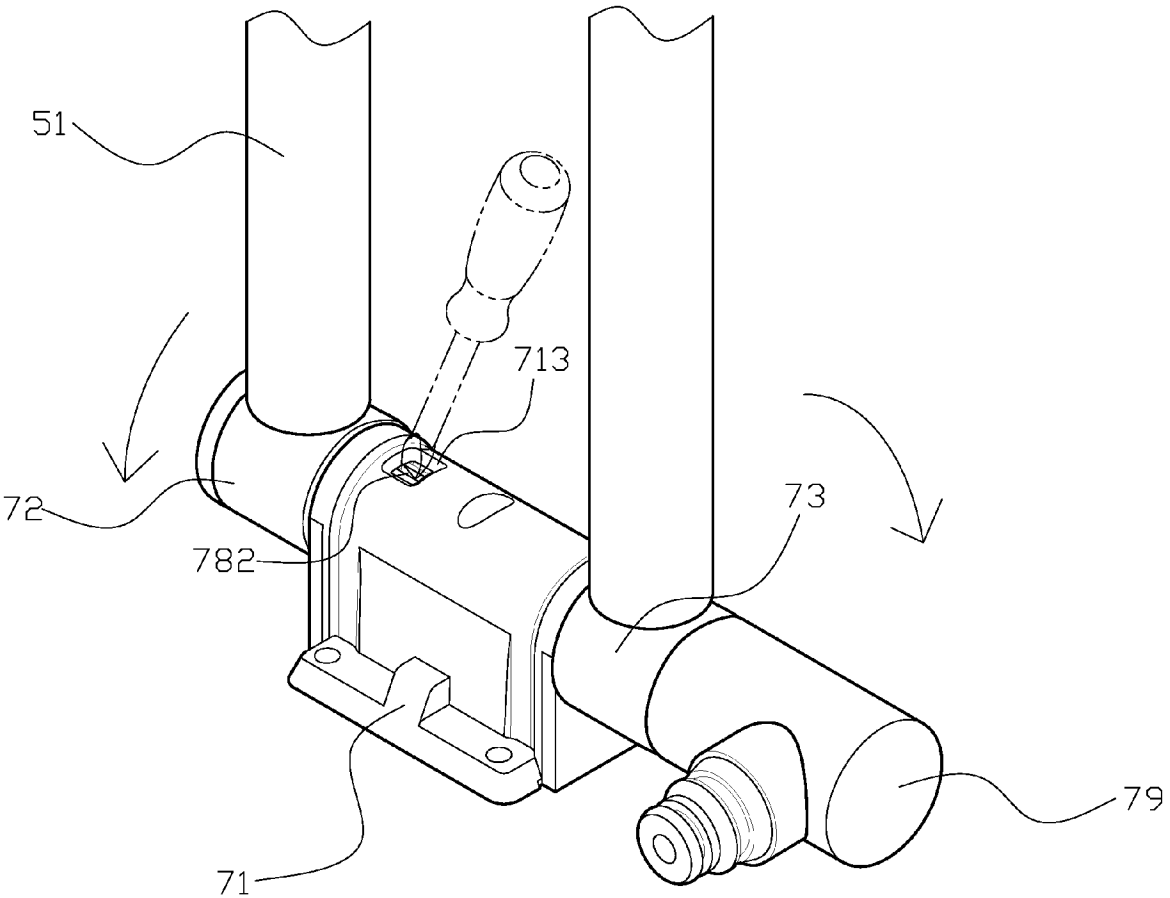
FIG. 14 PRIOR ART
FIG. 14 illustrates adjusting of a prior art shower head.
Figure 15:
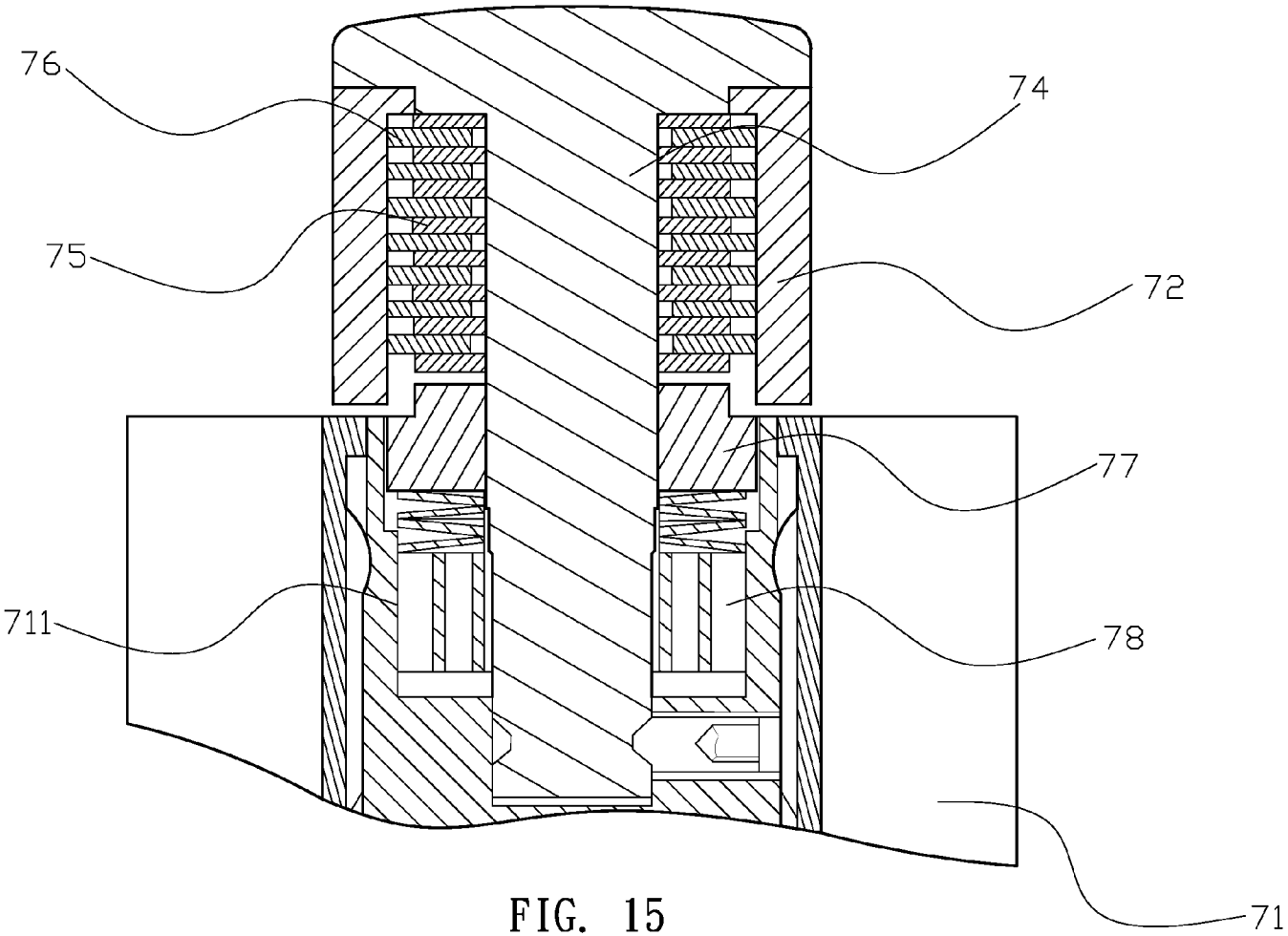
FIG. 15 PRIOR ART
FIG. 15 is a schematic drawing showing a flat washer and an engaging piece continuing to be together after the nut is loosened.

While adjusting the shower head 10, if the adjusting screw 38 is screwed too tight such that the shaft 34 cannot rotate completely, the user can also use the hand tool to loosen the adjusting screw 38. As a result, the engaging piece 36 is not pressed by the adjusting screw 38, and the rebound allowance between each engaging piece 36 and the two bevels of the elastic pieces 35 provide an elastic force on the elastic pieces 35, as shown in FIG. 10. Since the elastic pieces 35 elastically return back to their original shapes and thus do not tightly engage with the shaft 34, the shaft 34 driven by the toothed securing end 325 is able to spin in the third aperture 362 of the engaging piece 36 while the shower head 10 is being adjusted, as shown in FIG. 11. When the shower head 10 is adjusted to a desired angle, the user uses the hand tool to properly screw tight the adjusting screw 38 and replaces the cover 24, which causes the engaging piece 36 to be compressed to maintain the desired angle.

With the above-mentioned structure the following benefits can be obtained: 1. The user only needs to remove the cover 24 and use the hand tool to rotate the adjusting screw 38 to adjust the shower head without removing the casing 20, which is much easier than the prior art adjusting manner. 2. When the adjusting screw 38 is loosened, the elastic pieces 35 rebound back due to their elasticity and the two bevels to prevent friction between the elastic pieces 35 and the engaging piece 36 from causing adjustment difficulties. 3. When the shower head 10 is secured, it is not mechanically engaged but held by the elastic pieces 35; therefore, there is much less mechanical wear on the various parts, and the securing device has a longer life time. 4. With the elastic pieces 35, the shower head 10 can be secured for a long period of time which provides for increased safety. 5. The shower head securing device of the present invention has a simpler structure which provides for easier assembly and lower manufacturing costs.

Although the present invention has been explained in relation to its preferred embodiment, it is to be understood that many other possible modifications and variations can be made without departing from the spirit and scope of the invention as hereinafter claimed.

What is claimed is:

1. A shower head securing device comprising a shower head, a casing and a securing device, the securing device comprising a base, a joint tube, a securing nut, a shaft, a plurality of elastic pieces, a plurality of engaging pieces, a securing member and an adjusting screw; the securing device characterized in that:

the casing has a first aperture and a corresponding cover at a side, a sealed end of the joint tube having a protruding end, and a toothed securing end formed at a center position of the protruding end; the securing nut having at least a thread at its outer circumference and a second aperture larger than the diameter of the shaft through its center position; the shaft having a plurality of engaging slots evenly placed along its outer circumference from one end to another end and parallel along its axial direction to form a protruding strip between each engaging slot; each elastic piece having at least two bevels on a front surface and a toothed aperture through a center portion; side ends on the surfaces of each engaging piece corresponding to the bevels of the elastic pieces, the outer circumference of each engaging piece having a plurality of evenly spaced engaging protrusions, and a fourth aperture with a diameter larger than an outer diameter of shaft 34 that is disposed through a center portion of the engaging piece; the securing member having an engaging aperture corresponding to each engaging piece, and at least an inner thread with a predetermined length at each opening of the engaging aperture; the adjusting screw having a thread around an outer circumferential edge, an adjusting aperture disposed on a side surface, a fifth aperture disposed on another side surface and the diameter of the fifth aperture being larger than the outer diameter of the shaft;

wherein the engaging pieces sandwich each of two elastic pieces with both front surfaces facing each other, the shaft placed through the fourth apertures of the elastic pieces and the toothed apertures of the engaging pieces and such that the toothed apertures of the elastic pieces are engaged with the engaging slots and the protruding strips of the shaft; wherein when the shaft is placed into the securing member, the engaging protrusions of the engaging pieces are engaged with the engaging aperture of the securing member; the securing nut and the adjusting screw are screwed onto the inner thread disposed at the two opening edges of the engaging aperture of the securing member such that the adjusting screw admits the shaft in to the fifth aperture and pushes against all of the engaging pieces together to deform the elastic pieces to generate tightness applied onto the shaft; and wherein one end of the shaft protrudes out from the second aperture of the securing nut, the joint tube is pivoted onto the base, the securing member is jacketed into the joint tube to cause the shaft to insert into the toothed securing end, and when the casing is attached, the shower head is capable of being connected to a ball joint.

2. The shower head securing device as claimed in claim 1, wherein the shower head has at least one shower nozzle and an extension tube, and the shower head utilizes the extension tube for connection to the ball joint.

3. The shower head securing device as claimed in claim 1, wherein the casing has an opening disposed at a central position on an upper surface, and the shower head and the joint tube are connected through the opening.

4. The shower head securing device as claimed in claim 1, wherein a chamber is disposed in an upper portion in a vertical protrusion of the base, the chamber having a water channel connected to a first water intake hole and a second water intake hole in the vertical protrusion and capable of connection to the universal joint or a ball joint, the base further comprising a securing column and at least one securing hole on a horizontal protrusion, which are used for securing the securing member with screws.

5. The shower head securing device as claimed in claim 1, wherein one end of the joint tube is a jacket end with at least one seal ring, a third aperture is formed at a center position of the jacket end, a connecting tube is disposed at an outer side wall of the joint tube and connected to the third aperture, the joint tube is jacketed into the base and the connecting tube connects to the shower head.

* * * * *